US005718217A

United States Patent [19]

Aleman et al.

[11] Patent Number: 5,718,217

[45] Date of Patent: Feb. 17, 1998

[54] FIREPLACE SAFETY DEVICE

[76] Inventors: Javier Aleman, 2171 Whitebluff Way, Buford, Ga. 30518; Kevin B. McBurney, 1470 Ashbrook Dr., Lawrenceville, Ga. 30243

[21] Appl. No.: 648,753

[22] Filed: May 17, 1996

[51] Int. Cl.[6] ..... F24B 1/18

[52] U.S. Cl. ..... 126/500; 126/201; 126/242; 126/243; 126/298; 126/540; 126/542; 126/554

[58] Field of Search ..... 126/523, 201, 126/298, 277, 47, 542, 544, 243, 540, 554, 242, 500

[56] References Cited

U.S. PATENT DOCUMENTS

| | | | |
|---|---|---|---|
| 59,968 | 11/1866 | Coate | 126/298 |
| 168,922 | 10/1875 | Raveaud et al. | 126/555 |
| 976,819 | 11/1910 | Matter | 126/242 |
| 2,414,033 | 1/1947 | Flaacke | 126/298 X |
| 2,447,295 | 8/1948 | Waggoner | 126/298 |
| 2,600,753 | 6/1952 | Gilbert | 126/298 |
| 2,762,363 | 9/1956 | Hager | 126/298 |
| 4,058,108 | 11/1977 | Dahlquist | 126/298 |
| 4,338,916 | 7/1982 | Vaughn | 126/298 |
| 4,706,648 | 11/1987 | Blount et al. | 126/243 |

FOREIGN PATENT DOCUMENTS

| | | | |
|---|---|---|---|
| 439281 | 12/1935 | United Kingdom | 126/143 |

*Primary Examiner*—Larry Jones
*Attorney, Agent, or Firm*—James B. Middleton

[57] ABSTRACT

A safety device for fireplaces provides a non-flammable apron adjacent to the fireplace opening, the apron being sloped up in a direction away from the fireplace. Thus, logs or embers discharged from the fireplace will engage the apron, and will dissipate their energy in moving up hill. The device has a switch that is closed when the apron is contacted for sounding an alarm. A panel beneath the apron defines a space, and the air in the space will be heated. The heated air is directed into the living space, either by natural or forced convection.

12 Claims, 1 Drawing Sheet

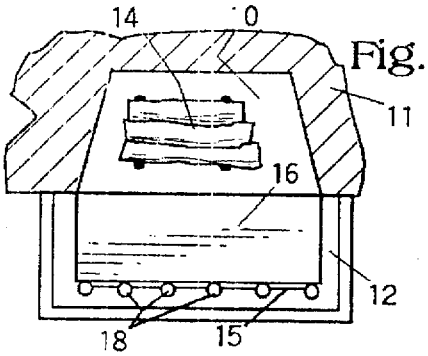
Fig. 1
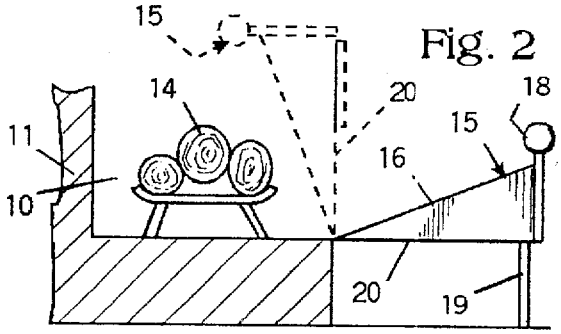
Fig. 2
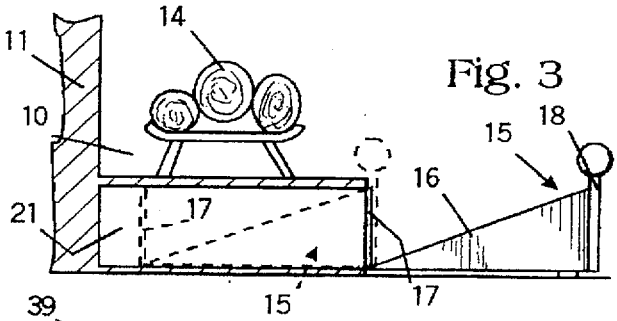
Fig. 3
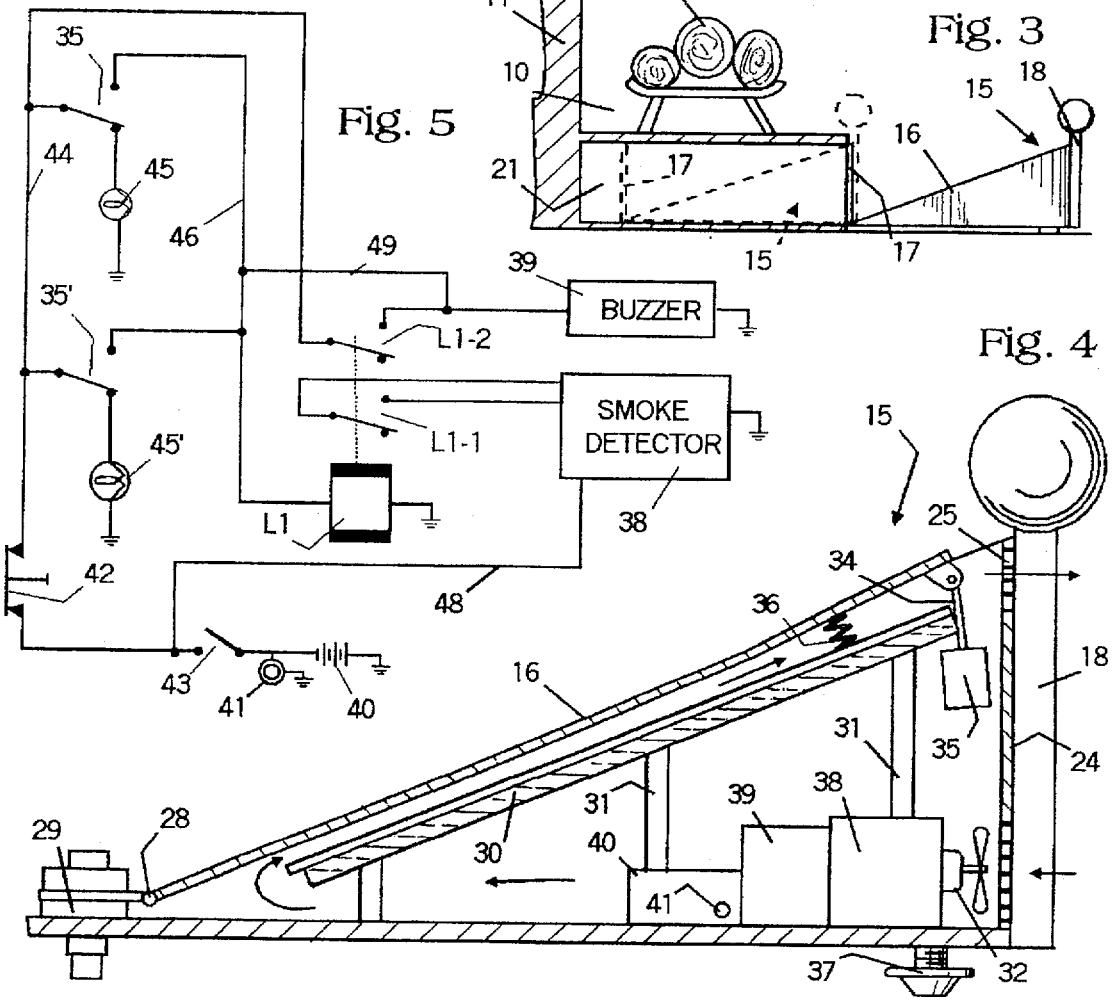
Fig. 5
Fig. 4

FIREPLACE SAFETY DEVICE

BACKGROUND OF THE INVENTION

1. Field of the Invention

This invention relates generally to safety apparatus, and is more particularly concerned with apparatus for safely catching material discharged from a fireplace, and providing an alarm therefor.

2. Discussion of the Prior Art

A fireplace usually includes a hearth or the like in front of the opening, so hot coals that may be discharged from the fireplace will be safely contained. If there is no masonry hearth, one generally provides a mat having a metal surface, and sufficient insulation to prevent burning the floor, or carpeting. It will be understood, however, that a hearth, or mat, is of a limited extent, and is of little value if, for example, a large log rolls off the grate or other support and rolls out of the fireplace. Due to the momentum of such a log, it may not stop on the hearth, but may roll onto the unprotected floor. Even if an entire log does not roll from the fireplace, suddenly shifting logs can discharge hot coals with enough energy that the coals may roll beyond the hearth.

The only safety device currently used is a screen in front of the fireplace. Such screens are really spark screens, and merely rest on the hearth. Such a screen could be moved by a large coal, a log or the like. Otherwise, one generally depends on andirons or the like to retain logs in the fireplace. One set of andirons specifically designed to catch logs is disclosed in U.S. Pat. No. 5,009,217. Furthermore, this patent discloses the idea of providing an alarm when a log rolls into the andirons. The alarm, however, is a simple mechanical contrivance that is unlikely to be noticed if people are engaged in other activities.

Thus, the prior art has not provided any safety means for safely catching logs, coals and the like that may be discharged from a fireplace.

SUMMARY OF THE INVENTION

The present invention provides a safety device for a fireplace, the device comprising an apron disposable in front of the fireplace for catching debris discharged from the fireplace. The apron is sloped upwardly away from the fireplace so debris will quickly lose its energy from rolling up hill. The apron is made of metal or other non-flammable material so hot coals will be safely contained on the apron. The device is preferably fixed to the fireplace, and may include its own andirons, fire screen or the like.

It is also contemplated that the safety device of the present invention will provide additional heat to the living space. The apron will receive heat form the fireplace, and this heat may be directed to the living space, either through natural convection or forced convection.

In one embodiment of the invention, the safety device includes an alarm that is activated when a large piece of debris engages the apron. A smoke detector can be included to detect smoke very early in the event a hot coal engages something flammable in the living space.

BRIEF DESCRIPTION OF THE DRAWINGS

These and other features and advantages of the present invention will become apparent from consideration of the following specification when taken in conjunction with the accompanying drawings in which:

FIG. 1 is a plan view, partially in cross-section, showing a fireplace having a safety device made in accordance with the present invention fixed thereto;

FIG. 2 is a side elevational view showing one form of installation of the safety device of the present invention, the fireplace being shown in cross-section;

FIG. 3 is a view similar to FIG. 2, but showing a different form of installation;

FIG. 4 is an enlarged cross-sectional view of a safety device made in accordance with the present invention; and, FIG. 5 is a schematic wiring diagram showing the controls for the device of FIG. 4.

DETAILED DESCRIPTION OF THE EMBODIMENT

Referring now more particularly to the drawings, and to that embodiment of the invention here presented by way of illustration, FIG. 1 illustrates a fireplace 10 defined by walls 11 of masonry or the like. Such a fireplace will generally include a hearth 12, also formed of masonry or other non-flammable material. As here shown, there are logs 14 within the fireplace 10. Disposed at the opening of the fireplace 10 is a safety device 15 made in accordance with the present invention.

It will be seen that the safety device 15 has a width approximately equal to that of the fireplace 10, though considerable variation is possible. Obviously the device 15 could be wider than the fireplace 10, but the device 15 could also be more narrow than the fireplace 10, and wings or the like could be used to funnel debris to the safety device.

As will be described in more detail hereinafter, the upper apron 16 of the device 15 is sloped upwardly in a direction away from the fireplace 10. At the forward, or the uppermost, edge of the device, there are posts 18 to assure that no log rolls beyond the apron 16.

FIG. 2 of the drawings shows a side elevational view of the safety device 15, all reference numerals being the same as in FIG. 1. FIG. 2, however, clearly shows the upwardly sloped platform 16. Also in FIG. 2 the floor of the fireplace 10 is above the floor level of the living area, and the safety device 15 is mounted at the level of the fireplace 10. While not here shown in detail, a simple hinge will be used to fix the rear end of the device 15 to the forward edge of the fireplace 10. A leg 19 at the front of the safety device 15 holds the device at the proper level.

Since the safety device 15 is hinged to the fireplace 10, the device can be pivoted up and the leg 19 folded, as shown in broken lines, when the fireplace is not in use. The safety device will then be out of the way, and will somewhat hide the fireplace. The bottom surface 20 of the device 15 may be attractively decorated to add an aesthetic touch to the fireplace.

Looking next at FIG. 3 of the drawings, the safety device 15 is shown as receivable, drawer-like, beneath the fireplace 10, the device 15 including a rear wall 17 for holding debris on the surface 16. This arrangement may be desirable for new construction, since the drawer space 21 could be prepared more easily. For old construction, the arrangement shown in FIG. 1 or 2 may be preferred. Thus, the device of the present invention may be built in, subsequently attached, or remain as a separate device.

Attention is now directed to FIG. 4 of the drawings for a full understanding of the construction and operation of the safety device of the present invention. In FIG. 4 it will be seen that the device includes a base plate 22 and a front wall 24. The base plate 22 has adjustable feet 37 for leveling the device, though a sand-bag base or other leveling means may be utilized. There is a plurality of posts 18 fixed to the front wall 24 and distributed therealong as is shown in FIG. 1. Horizontal bars can connect the posts if desired; and, the bars may support a secondary fire screen. The front wall 24 defines upper and lower openings 25 and 26 which will be discussed further below.

The upper apron 16 is preferably formed by a sheet of metal, the apron 16 being pivotally carried at its lower end at 28. The arrangement is such that the apron 16 can pivot about the axis of the pivot 28 in response to weight placed on the apron 16. The support for the pivot 28 preferably includes heat insulating blocks 29.

Below the apron 16 and generally parallel thereto is a sloped panel 30. The panel 30 is rigidly supported from the base plate 22 by a plurality of posts 31. Obviously many other supporting arrangements can be used, but it is important that the supports 31 allow air flow through the body of the device.

As here shown, the panel 30 has a sheet of metal on its upper surface, and a heat-insulating material on its lower surface. The specific materials may vary, but one function of the panel 30 is to protect the various components within the device from excess heat.

With the above description in mind, it will be understood that the apron 16 will be close to a fire in a fireplace, and will naturally absorb some heat. The surface of the apron 16 may be colored black, textured and the like to enhance the heat-absorption ability. Since the apron 16 will be hot, the air that touches the platform will be heated, and will tend to rise by normal convection. It will be noticed that the space between the apron 16 and the panel 30 is slightly wider at the top (front) than at the bottom (rear). This is to enhance the chimney effect to obtain the maximum air flow. It will also be noticed, however, that there is a fan 32 adjacent to the opening 26 in the front wall 24. The fan is to force the desired air-flow, and the increased space between the apron 16 and the panel 30 may be omitted. Air is discharged through the opening 25 in the front wall 24.

When a piece of debris engages the apron 16, first the debris is rendered generally harmless because the apron 16 is not flammable. In addition, the debris must roll up hill, so its motion should be stopped quickly. For complete safety, however, it is preferable to provide an alarm so someone can monitor the condition to be sure it is not hazardous. Thus, the front edge of the apron 16 is connected to a plunger 34 which operates a microswitch 35. It is contemplated that such an arrangement will be at each side of the platform for good sensitivity, so there will be switches 35 and 35. There are springs 36 supporting the apron 16, and the strength of the springs 36 can be varied to vary the sensitivity of the system.

The use of microswitches as shown in FIG. 4 is a simple way to provide the electrical signal needed, but other switch means may be used. For example, the apron itself may be one switch contact, and the panel 30 may be the other switch contact. Weight on the apron 16 would cause the two pieces to touch, yielding the electrical signal desired.

Attention is now directed to FIG. 5 of the drawings, which illustrates an electric control circuit for the device shown in FIG. 4. As shown in FIG. 5, there is a smoke detector 38 as well as a buzzer or other alarm device 39. Either of these may be omitted if desired, though both provide alarm signals. The smoke detector 38 and buzzer 39 are also shown in FIG. 4, so placed that outside, cool air passes over the components to keep them cool. A battery container 40 is adjacent, the battery container 40 including a jack 41 for an external power supply.

Thus, the battery 40 is connected through an "on-off" switch 43, then through a normally closed pushbutton 42 to a bus 44. The common points of the switches 35 and 35' are connected to the bus 44, and their normal points are connected to lights 45 and 45'. As a result, when the system is in operation, illumination of the lights 45 and 45' will indicate that all is normal. The on-off switch 43 may be a manual toggle switch, or may be a thermally activated switch that will close any time the surface 16 is sufficiently warmed.

The transfer points of the switches 35 and 35' are connected to a bus 46, which is connected to the coil of a relay L1. As a result, when at least one of the switches 35 and 35' is transferred, the relay L1 will be energized, transferring its contacts L1-1 and L1-2. Contact L1-1 causes the smoke detector 38 to emit its signal, power being supplied to the smoke detector through the line 48. Contact L1-2 connects the bus 44 to the buzzer 39, and holds the relay L1 through the line 49.

Once one of the switches 35 and 35' has been activated to start the alarm, the alarm will continue until the pushbutton 42 is used to break the circuit.

Those skilled in the art will readily understand that many forms of alarm may be used. The smoke detector is advantageous because the flow of air through the device will draw in any smoke in the vicinity, rendering the device very sensitive. Instead of, or in addition to, the buzzer 39, one may use strobe lights for the deaf, telephone dialing equipment or other well known alarm systems.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

We claim:

1. A fireplace safety device, for use in conjunction with a fireplace having an opening, and a floor in a living space adjacent to said opening, said safety device comprising an apron located in said living space said opening to receive debris that is discharged from said fireplace through said opening, said apron being angled with respect to said floor so that such debris will move up hill as it moves away from said fireplace, said apron being non-flammable, said safety device further including a panel beneath said apron and approximately parallel thereto, said panel including thermal insulation for confining heat to a space defined between said apron and said panel.

2. A fireplace safety device as claimed in claim 1, and further including fan means for moving air through said space defined between said apron and said panel.

3. A fireplace safety device as claimed in claim 1, wherein said space defined between said apron and said panel is wider at the top for promoting convection currents through said space.

4. A fireplace safety device, for use in conjunction with a fireplace having an opening, and a floor in a living space adjacent to said opening, said safety device comprising an apron located in said living space at said opening to receive debris that is discharged from said fireplace through said opening, said apron being angled with respect to said floor so that such debris will move up hill as it moves away from said fireplace, said apron being non-flammable, and further including pivot means for pivotally mounting said apron, switch means operable by pivotal motion of said apron, and alarm means activatable by said switch means.

5. A fireplace safety device as claimed in claim 4, said safety device further including a panel beneath said apron, said panel including thermal insulation for confining heat to a space defined between said apron and said panel.

6. A fireplace safety device as claimed in claim 5, said safety device including a base plate supporting said apron and said panel, said alarm means being fixed to said base plate beneath said panel.

7. A fireplace safety device as claimed in claim 6, and further including means for leveling said base plate.

8. A fireplace safety device as claimed in claim 6, and further including an electric power supply fixed to said base beneath said panel, and circuit means for causing said switch means to activate said alarm means, said circuit means being on said base plate beneath said panel.

9. A fireplace safety device as claimed in claim 8, wherein said panel is approximately parallel to said apron, and wherein said space between said apron and said panel is wider at the top for promoting convection currents through said space.

10. A fireplace safety device as claimed in claim 8, wherein said panel is approximately parallel to said apron, and including fan means mounted between said base plate and said panel for moving air through said space defined between said apron and said panel.

11. In a fireplace having an opening, and a floor in a living space adjacent to said opening and below said fireplace, the improvement comprising a drawer selectively receivable beneath said fireplace and selectively disposable over said floor adjacent to said opening so that said drawer is located to receive debris discharged from said fireplace, the further improvement wherein said drawer comprises a safety device including an apron angled with respect to said floor so that said debris discharged from said fireplace will move up hill as it moves away from said fireplace, said apron being non-flammable.

12. In a fireplace as claimed in claim 11, the improvement wherein said safety device further includes a panel beneath said apron and approximately parallel thereto, said panel including thermal insulation for confining heat to a space defined between said apron and said panel.

* * * * *